US007151445B2

(12) United States Patent
Medve et al.

(10) Patent No.: US 7,151,445 B2
(45) Date of Patent: Dec. 19, 2006

(54) METHOD AND SYSTEM FOR LOCATING A DEPENDENT

(76) Inventors: Ildiko Medve, 145 Fernwood Dr., East Greenwich, RI (US) 02818; George Sai-Halasz, 145 Fernwood Dr., East Greenwich, RI (US) 02818

( * ) Notice: Subject to any disclaimer, the term of this patent is extended or adjusted under 35 U.S.C. 154(b) by 189 days.

(21) Appl. No.: 11/032,450

(22) Filed: Jan. 10, 2005

(65) Prior Publication Data

US 2006/0164237 A1 Jul. 27, 2006

(51) Int. Cl.
*G08B 1/08* (2006.01)

(52) U.S. Cl. ..... 340/539.15; 340/539.13; 340/572.1; 340/573.1; 340/573.4; 340/825.49; 340/825.69

(58) Field of Classification Search ..... 340/539.15, 340/539.13, 572.1, 573.1, 573.4, 825.49, 340/825.69; 235/380, 381, 383, 385; 700/22, 700/28, 215
See application file for complete search history.

(56) References Cited

U.S. PATENT DOCUMENTS

| | | | | |
|---|---|---|---|---|
| 5,493,283 | A * | 2/1996 | Hopper et al. | 340/5.8 |
| 5,973,598 | A | 10/1999 | Beigel | 340/572.1 |
| 5,977,913 | A | 11/1999 | Christ | 342/465 |
| 5,978,493 | A | 11/1999 | Kravitz | 382/115 |
| 6,204,765 | B1 | 3/2001 | Brady | 340/572.1 |
| 6,225,906 | B1 * | 5/2001 | Shore | 340/573.4 |
| 6,375,780 | B1 | 4/2002 | Tuttle | 156/226 |
| 6,427,913 | B1 | 8/2002 | Maloney | 235/383 |
| 6,463,039 | B1 * | 10/2002 | Ricci et al. | 370/277 |
| 6,496,806 | B1 | 12/2002 | Horwitz | 705/28 |
| 6,529,131 | B1 | 3/2003 | Wentworth | 340/573.1 |
| 6,600,418 | B1 | 7/2003 | Francis et al. | 340/572.1 |
| 6,747,562 | B1 | 6/2004 | Giraldin | 340/573.1 |
| 6,753,782 | B1 | 6/2004 | Power | 340/573.4 |
| 2004/0008114 | A1 | 1/2004 | Sawyer | 340/572.1 |
| 2004/0027243 | A1 | 2/2004 | Carrender | 340/568.1 |
| 2004/0085191 | A1 | 5/2004 | Horwitz | 340/10.3 |
| 2004/0112957 | A1 | 6/2004 | Elledge | 235/382 |
| 2004/0160324 | A1 | 8/2004 | Stilp | 340/572.13 |
| 2004/0167820 | A1 | 8/2004 | Melick | 705/16 |
| 2004/0178913 | A1 | 9/2004 | Penuela | 340/573.1 |
| 2004/0201479 | A1 | 10/2004 | Garber | 340/572.1 |
| 2005/0027604 | A1 | 2/2005 | Bandy | 705/22 |
| 2005/0061879 | A1 | 3/2005 | Honda | 235/385 |
| 2005/0073419 | A1 | 4/2005 | Gary | 340/573.1 |
| 2005/0091896 | A1 | 5/2005 | Kotik | 40/633 |
| 2005/0093698 | A1 | 5/2005 | Sakamoto | 340/572.1 |
| 2005/0280546 | A1 | 12/2005 | Ganley | 340/573.4 |
| 2006/0017551 | A1 | 1/2006 | Neher | 340/426.19 |
| 2006/0028346 | A1 | 2/2006 | White | 340/573.4 |

* cited by examiner

*Primary Examiner*—Hung Nguyen
(74) *Attorney, Agent, or Firm*—George Sai-Halasz

(57) ABSTRACT

A method and system for locating a dependent by a guardian entity at a locality using RFID technology is disclosed. A RFID tag is situated with the dependent and a plurality of RFID reader devices capable of communicating with the RFID tag are distributed about the locality. A processor is directing communications between the RFID tag and the plurality of RFID reader devices, and is tracking the RFID tag. An authenticating system, which uniquely associates the RFID tag with the guardian entity, validates commands pertaining to the tracking of the RFID tag. The processor upon receiving a validated command generates a response, which includes location information regarding the dependent.

21 Claims, 3 Drawing Sheets

METHOD AND SYSTEM FOR LOCATING A DEPENDENT

FIELD OF THE INVENTION

The present invention relates to the use of Radio Frequency Identification (RFID) technology insuring safety and security. In particular it relates to a system and method for helping a guardian entity not to become separated from a dependent in places frequented by the public.

BACKGROUND OF THE INVENTION

Upon visiting a place frequented by the public, somebody who is responsible for a dependent person, a guardian, typical case being a parent of a child, is in a constant state of apprehension, and occasionally in great fear, that the dependent will become separated and lost. This can happen either because the guardian and the dependent inadvertently wander away from each other, or worse, there is the possibility of foul play, such as an attempted abduction of the dependent.

Today we have Radio Frequency Identification (RFID) technology. RFID technology is well know in the art. The roots of this technology go back over two decades, and by now it is becoming pervasive. Basically it has three components: a RFID tag, a RFID reader device, and a host processor. The RFID tag and RFID reader device, which is also commonly called interrogator device, are both equipped with antennas and can communicate with each other at radio frequencies. The RFID tag can be passive or active type. A passive RFID tag has no source of power of its own, while an active one is independently powered. RFID tags can also be sorted as read only ones or read/write ones. The processor directs communications between the RFID tag and RFID reader device and contains most of the software to run the particular RFID technology application. At any given location the processor can keep track of a very large number of individual reader devices and tags. For simplicity and brevity, from here on the RFID tag at times may be referred to only as "tag", and the RFID reader device only as "reader device", or "reader". Components of the technology are commercially readily available, from a variety of companies, such as Motorola Inc., Texas Instruments Inc., Intermec Technologies Corp., and others. Processors suitable for the task additionally can also be found at many computer vendors, such as International Business Machines Corp., Sun Microsystems Inc., Dell Inc., Hewlett Packard Co., and others.

A further look at the background of RFID technology can be gleaned from this sample list of U.S. Pat. Nos. 5,528,222; 5,550,547; 5,673,037; 5,673,037; 5,912,632; 5,995,019; 6,204,765; 6,215,402; 6,429,775 with all of these patents herein incorporated by reference. Also large amount of information regarding RFID technology is available on the Internet, some of if from the providers of the technology, apparently for the education of their customers.

Using RFID technology to track people, animals, objects, etc., has been disclosed earlier, for instance, in US patent "Method and apparatus for tracking and locating personnel" U.S. Pat. No. 5,977,913, and "Object control and tracking system with zonal transition detection" U.S. Pat. No. 6,427,913, but these patents do not teach the present invention. U.S. Pat. No. 6,753,782 "System for monitoring patients with Alzheimer's disease or related dementia" uses RFID technology to track, monitor, and protect Alzheimer patients, but does not teach the present invention.

SUMMARY OF THE INVENTION

Anything that can help locating a lost dependent in a place frequented by the public would be much welcome by all who ever had the responsibility to look after a dependent. The present invention offers such help with the use of RFID technology.

Commonly, the very possibility of foul play may cause a guardian to panic when such a guardian suddenly realizes that a dependent is out of sight. Such a feeling is known to almost every adult, and certainly to parents. Use of the present invention may ease such fears by giving a measure of assurance that the dependent would be quickly found. The present invention can also alert a guardian of a situation where the dependent may be lost, even before the guardian on its own would become aware of the condition.

The invention contemplates a method and system for locating a dependent by a guardian entity at a locality, by situating a RFID tag with the dependent and distributing about the locality a plurality of RFID reader devices capable of communicating with the RFID tag. Directing communications between the RFID tag and the plurality of RFID reader devices, and tracking the RFID tag as the dependent is moving about the locality in a processor. Uniquely associating the RFID tag with the guardian entity in an authenticating system, since a command which pertains to the tracking of the RFID tag is accepted by the processor only if the command is validated by the authenticating system. Finally, upon receiving a validated command in the processor, generating a response, which response provides the guardian entity with location information regarding the dependent.

The invention contemplates a system and method for keeping a first mobile RFID tag within a zone of a second mobile RFID tag at a locality by including a plurality of RFID reader devices capable of communicating with the first mobile RFID tag and the second mobile RFID tag, where the plurality of RFID reader devices are distributed about the locality. A processor having a memory is directing communications between the plurality of RFID reader devices and the first mobile RFID tag and the second mobile RFID tag, and the processor is tracking the first mobile RFID tag and is tracking the second mobile RFID tag about the locality. Furthermore the processor is performing a correlation of the tracking of the first mobile RFID tag and of the tracking of the second mobile RFID tag, and if the processor is recognizing in the correlation a pattern of moving out of the zone by the first mobile RFID tag then the processor is issuing an alert. The pattern of moving out of the zone has been stored in the memory of the processor.

The invention contemplates a method and system for finding a child by a guardian entity at a place frequented by the public, by dispensing a RFID tag to the child, situating the RFID tag with the child, and distributing about the place frequented by the public a plurality of RFID reader devices capable of communicating with the RFID tag. Directing communications between the RFID tag and the plurality of RFID reader devices, and tracking the RFID tag as the child is moving about the place frequented by the public in a processor. Furthermore, dispensing a code to the guardian entity, which code is uniquely associated with the RFID tag and it is suitable to be entered into the processor. And, the processor upon receiving the code is generating a response which provides the guardian entity with location information regarding the child.

BRIEF DESCRIPTION OF THE DRAWINGS

These and other features of the present invention will become apparent from the accompanying detailed description and drawings, wherein.

DETAILED DESCRIPTION OF THE INVENTION

Figure 1:
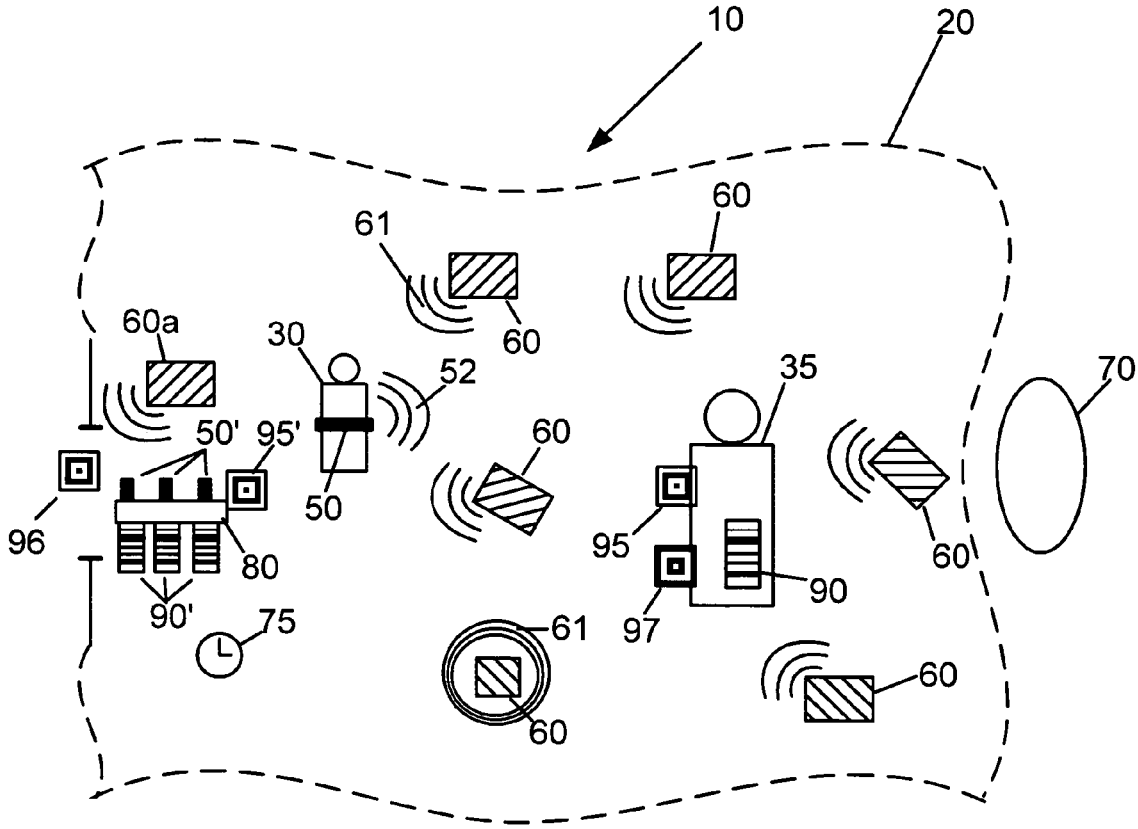
FIG. 1 shows a schematic view of an exemplary embodiment for a system and method to locate a dependent.

The figures of the disclosure show schematic views of exemplary embodiments of a system or method 10 for locating a dependent 30. The dependent 30 may typically be a child, meaning a person under about 12 years of age. More usual would be the situation when the child may be between about one and a half and 7 years of age. The disclosure contemplates a situation which may often arise, namely that a dependent 30 whereabouts have to be known, and possibly communicated, because a guardian entity 35 of the dependent wishes to know them, and possibly because the guardian entity worries that the dependent is missing, lost, and thereby endangered. Such a guardian entity commonly would be the parent of the dependent. However, the terms dependent and guardian entity are much broader then the child and parent. The system and method presented in this disclosure can cover a broad range of conditions and relations for a first entity, the dependent, and a guardian entity. Such may be the case when the first entity would be in some sort of peril if the guardian entity would be absent, or, when the guardian entity, for whatever reason desires not to separate from the first entity, and many other similar eventualities. Thus, if a dependent is a child, the guardian entity, besides a parent, could be a nanny, an older sibling, friend of the family, and in general any person into whom trust can be placed regarding the child. The dependent might also be a feeble, or older person, or a rebellious youth. The dependent, of course, also can be a very young child such as an infant in a carriage. Such a very young child would not walk away from a guardian entity, but certainly is in danger of being left behind, or abducted. The dependent could even be a pet, with the guardian entity typically being the owner, or a surrogate of the owner. In general, the common theme is that the guardian entity is one who, for whatever reason, may be responsible, or offers responsibility, for the dependent not to go missing. Such would include authority figures, for instance, a security guard or an employee of a place frequented by the public, or police authorities, and others when by their actions take direct, or surrogate, responsibility for a dependent. Such are all considered guardian entities for purposes of this invention. In an exemplary embodiment the dependent is a child, and the guardian entity is the guardian, likely the parent, of the child.

The terms missing, lost, imperiled, and similar terms typically include situations when a dependent, such as a child, simply walks away from a distracted adult guardian entity, or the other way, when a guardian entity inadvertently leaves the dependent behind. However, missing, lost, imperiled, and similar terms might also include situations of potential foul play, such as an attempted abduction.

The system and method of the invention typically would be applied at a given locality, which simply is a place frequented by the public. Such a locality contemplated by the invention might be, without being limited to, a department store, a supermarket, a mall, a hotel, a sports arena, a skiing resort, a festival, a parade, and in general any place where there is a possibility for enough people to gather that there may be a concern for the dependent to go missing. The extent, or size, of the locality, however, typically would not exceed the extent of large edifices, couple of city blocks, size of a golf course, few ski slopes, and similar extensions. Ultimately, the extent of the locality rests on the RFID technology itself. Since the invention makes use of RFID technology, a reasonable fraction, at least over about 20% of the location would preferably be covered by the ranges of the RFID reader devices. The more of the locality is covered by reader devices the better the expected operation of the invention. Such considerations predefine the extent, or size, of the contemplated locality.

The invention makes use of RFID technology, which is expected to be pervasive with its presence in many places frequented by the public. Such a locality, for instance a department store, probably would desire to increase the safety level of their visitors, and would prefer to install a RFID technology capable to execute the present invention. Such an endeavor may be easy and inexpensive, considering that a large fraction of places frequented by the public are expected of have RFID technology in place in any case for commercial reasons. Such commercial reasons are well know for those skilled in the art. It is expected that if a place frequented by the public has, or is contemplating, to install RFID technology for commercial reasons, modifying such a system such that it can also be used for carrying out the present invention would entail a minimal effort and expenditure.

An RFID tag is detected by an reader device if the tag is in the range of coverage of the reader device. As it is well know by those skilled in the art, the communication between the tag and the reader device is at such frequencies that there is no need for line of sight between the tag and the reader device. Accordingly, the knowledge of a RFID tag being detected by a specific reader device, which is located in a specific place, informs that the RFID tag is physically present within a fairly well known range around a specific point. This, of course, is a location information regarding the RFID tag. If there is a plurality of reader devices, each at a known location, and each one with a known range of coverage, then a RFID tag can be tracked as it moves in and out of the ranges of various reader devices, as it moves about the locality. If the RFID tag is situated with a dependent, typically affixed to the dependent, then the location of the dependent is known at any given time with the accuracy of at least the range of coverage of the reader device, or more accurately if some of the coverage ranges overlap, or more advanced RFID tag locating technology is used, as known in the art. The term "tracking" means following the spatial and temporal progression of a RFID tag. For this invention the processor has only a functional role. The particulars of the computing entity, such as whether it is a single processor or a network of them, and other common features known in the art, are of no interest, and all fall under the scope of the invention. In a representative embodiment the spacial and temporal data obtained by the processor while tracking a RFID tag would be stored for ready recall in case of need. However, there may be embodiments when only the latest spacial and temporal information of a tag is needed, and little, or none, of it would be stored by the processor.

Programming a processor which directs communications between the reader devices and RFID tags to track the motion of a specific RFID tag based upon the known locations and coverage ranges of the reader devices is a straightforward task, which, for instance, is similarly done in RFID technology for tracking movement of merchandise in warehouses. Consequently, in a locality properly covered by sufficient number of reader devices, the location of a dependent situated with a tag, such as a child wearing a tag, can readily be tracked by a processor. The precision of this tracking depends on the degree of the overall blanketing by the coverage ranges of the individual reader devices. A well blanketed place would be such that any spot would fall in the coverage range at least one reader device. A less well covered place might have some spots that fall outside the range of all reader devices, resulting in grey zones. However, even in such cases the processor can have useful information, such as which reader device had the tag in its rage last, which reader device might likely detect the tag again, etc. Depending on the amount effort an expense invested in the tags and readers, which in turn depends on the safety needs of a specific locality, one can use more precise location determinations than one just based on the knowledge that a tag is in the range of coverage of a specific reader device. Schemes exist to extract motion and location within a coverage range, as given for instance in U.S. Pat. No. 6,204,765 "Method of detecting relative direction of motion of a radio frequency (RF) tag", incorporated herein by reference. Also, the already mentioned U.S. Pat. No. 6,753,782 "System for monitoring patients with Alzheimer's disease or related dementia" incorporated herein by reference, which teaches triangulation and other schemes to obtain precise location of a tag within a coverage ranges.

There is a great variety of coverage ranges for reader devices available in RFID technology. Such ranges can span orders of magnitudes, from less than a meter to tens of meters, or maybe even over a hundred meters, depending on both the reader devices and tags that are in use. As the need arises one has wide variety of choices regarding coverage ranges of the reader devices, for satisfying differing embodiments of the present invention.

Having a processor track a dependent, which dependent by its very nature, such as being a child, has a chance of being lost, or tracking somebody other than a child, who for whatever reason has a guardian entity, is only part of the task. The information gained from such tracking might have to be communicated, and possibly acted upon. For many reasons, such as the danger of foul play, or privacy, information derived from such tracking typically is made available only to properly authenticated individuals, such as the guardian entity. However, there may be times and situations when the correct course of action regarding the tracking information may be very public, such as activating a public alarm.

The teaching of the present invention includes, a RFID tag situated with a dependent, typically a child; RFID reader devices; tracking of the tag by a processor using the communications between the RFID tag an the reader devices; an authenticating system uniquely associated with the RFID tag and uniquely associated with the guardian entity of the dependent; and a response of the system directed toward, or promoting, remedy in locating the dependent. Since the RFID tag is situated with a dependent, and the dependent is moving about the locality, the task of the locating system is to track a mobile RFID tag and to appropriately inform the guardian entity in case of need. The authenticating system secures that in regard the tracking information of the RFID tag the processor is responding only to validated command, which is on behalf of the guardian entity, whereby safeguarding sensitive information from falling into wrong hands.

Considering the ever present danger of foul play and questions of privacy, the system in an exemplary embodiment could use a RFID tag 50 which is be affixed to the dependent 30 in a hidden manner. Many acceptable ways can be devised that would allow a small thing such as a RFID tag to be hidden on the dependent, even if the dependent is a small child. A simple way would be just to put the tag in a pocket of the dependent, but practically endless more ways could be found, and would be obvious to guardians. The tag itself my have some physical attribute, such as a pin, glue, being of bracelet shape, etc., that might facilitate both affixing onto the dependent and hiding.

The advantage of hiding a tag on a dependent might be to avoid the removal of the tag by a potential abductor, who would be intent on frustrating the locating system. Hiding the tag might also be desired by the dependent, who might resent being seen in public wearing a tag. Affixing tags to the dependent 30 in a hidden manner might even protect all children in the place frequented by the public. A potential abductor would not know which child is protected by the tag and which one is not. The danger for the perpetrator in abducting a dependent wearing a hidden tag, and being caught, might be sufficient to discourage such activities in their entireties.

The system and method can work with multiple dependents, such as children, and multiple guardian entities, in whatever combination of numbers. For instance multiple RFID tags can be associated with a single guardian entity, or several guardian entities can be associated with a single RFID tag, or several of each, can be associated in any combination, although one would expect the number of dependents usually to exceed the number of guardian entities. The number of RFID tags and guardian entities associated with each other, typically would not exceed small pluralities, which means between 2 and about 20 for dependents, and between 2 and about 10 for guardians.

The authenticating system of the present invention can be realized in several particular embodiments. For instance, in an exemplary embodiment the authenticating system may be realized through personal identification characteristics, such as fingerprints, facial recognition etc. An authenticating system may simply be an ID card that the guardian entity presents to a properly authorized operator of the system, with the unique association between the tag and the guardian contained in the identities of the dependent and the guardian entity. Independently of the particular embodiment, the present invention contemplates all systems that can secure that the information regarding the RFID tag situated with the dependent is falling only in the right hands, and that the information it is acted upon only on behalf of the guardian entity. The figures of the present disclosure show a few representative embodiments, with the full understanding that many more schemes of authentication are realizable.

FIG. 1 shows a schematic view of an exemplary embodiment for a system 10 to locate a dependent 30. A locality 20 is shown with a broken line boundary, thereby not trying to convey information regarding structure, since the variety of such places can be truly large. Such a locality can be indoors or outdoors, including all kind of shopping places, exhibition arenas, sporting venues, entertainment venues, malls, festivals, parades, and many more. In each of such places there is danger that a dependent may go missing. A RFID tag 50 is situated with the dependent 30, namely it is at the same location as the dependent 30. In an exemplary embodiment the RFID tag 50 is in some manner affixed to, or fastened thereon the dependent 30. This can be accomplished, for instance, using the clothing of the dependent, a bracelet scheme, or any other mean. The particulars of the physical attachment of the RFID tag 50 to the dependent 30 can follow known general schemes of affixing items. The RFID tag has an antenna capable of receiving and transmitting electromagnetic waves 52, typically at a radio frequency. For a basic operation of the system the tag does not have to contain a large amount of information, indeed the pertinent information may be as little as a single number, just sufficient to identify the particular dependent. Accordingly the tag may be a very simple, small, and inexpensive one, such as a so called "smart label". However, depending on circumstances, many other differing kind of RFID tags can serve the purposes of the present invention.

There is a plurality of reader devices 60 distributed about the locality. The size of the plurality of the RFID reader devices depends on the extent, or size, of the locality. Accordingly, the size of the plurality of the RFID reader devices can be expected to be possibly as small as 2, and possibly as large as in the thousands, such as 10,000. A more typical range of the size of the plurality of the RFID reader devices would be between a few tens to a few hundreds. Each such reader device has an antenna transmitting and receiving electromagnetic waves 61, typically at radio frequency. Each one such reader device has a range of coverage. These ranges can vary in extent, since the reader devices do not have to be identical to one another, and the immediate surrounding of each reader device might also be different, influencing of the range of coverage. This is schematically indicated in the figures by using differing shapes of reader devices 60 and differing shapes for their electromagnetic waves 61. In reality, of course, there are can be vast variations, and the schematic showing in the figures should not be read in a limiting fashion. Furthermore, the range of coverage depends on the RFID tag as well, since differing RFID tags have different capabilities. Range of coverage is a mutual property involving the electromagnetic waves of the RFID tag 52 and those of the reader devices 61.

A processor 70 directs communications between the plurality of reader devices 60 and the RFID tag 50. For any given actual locality, the processor 70 preferably is programmed to be fully aware of, namely having stored, the coverage ranges in all their detail of the individual reader devices 60, when interacting with a particular type of RFID tag 50. The processor 70 can track the RFID tag based on the knowledge of which particular reader device 60 has the RFID tag in its range. The more reader devices there are, and the more they blanket the locality, the more accurate can the tracking information be. The tracking information extracted by the processor 70 preferably has both temporal and spatial information. As already said, the processor itself is of interest for the invention only through its functionality. Where the processor 70 is located, or what kind is it, how does it communicate with the reader devices, and other details of the processor are not of particular interest. The processor, or processors, might even be located quite far from the place frequented by the public 20, Various figures show the processor both inside and outside the locality 20 indicating the processor is only relevant trough its functionality, while its physical location and other attributes are irrelevant.

Typically, the dependent 30, who may be a child, is accompanied and looked after by a guardian entity 35. A guardian entity 35 under normal conditions will always be aware of where the dependent 30 is, typically directing activities in a manner that the dependent 30 remains nearby, usually within sight. However, as every guardian knows, probably due to first hand experience, there may come a dreaded moment, when the guardian entity 35 realizes that the dependent 30, "vanished". The guardian entity needs to know the whereabouts of the dependent as soon as possible, however, information such as the location of a lost child could be very dangerous if it fell into wrong hands. Accordingly, the present invention includes an authenticating system which uniquely associates the RFID tag 50 with the guardian entity 35. Consequently, processor 70 responds to a command, for instance, to display location of the RFID tag 50, only if the command is validated by an authenticating system.

In the exemplary embodiment of FIG. 1 the authenticating system can be a code 90, and the proper command includes entering the code 90 into the processor 70. The code 90 is schematically represented on FIG. 1 as a bar code, and indeed it could be a bar code, which is associated with the guardian entity 35, typically by being in the possession of the guardian entity. The code 90 is also uniquely associated with the RFID tag 50 which is situated with the dependent 30.

In a representative embodiment there are means for dispensing the RFID tag, at which point the needed associations can also be accomplished. In an exemplary embodiment the dependent 30 and the guardian entity35, possibly a child and a parent, enter somewhere the locality 20, such as at an entrance door of a department store. An entrance is a reasonable location for a dispenser 80. Such a dispenser 80 would distribute the needed elements of the system to the guardian entity and the dependent. Lets assume, without limiting possibilities of other variations, that the RFID tag 50 is some kind of smart label, well known to those skilled in RFID technology. Such a smart label can be dispensed quite simply without the need of operator involvement. From the guardian's point of view such a dispenser of labels could appear very similar to the familiar "taking of a number" scheme used for serving customers the order of their arrival, or to a shopping coupon dispenser. However, RFID technology art has many ways to dispense RFID tags, and many such ways can be contemplated for the purposes of the present invention. A tag dispenser scheme is disclosed, for instance, in US patent "Method of manufacturing an enclosed transceiver", U.S. Pat. No. 6,375,780, incorporated herein by reference.

In an exemplary embodiment the guardian entity 35 can receive from the dispenser one smart label 50 together with a tear off slip containing a bar code 90. It is contemplated that the act of taking the tag 50 registers with the processor 70, which then enters that particular RFID tag into the system, and also registers the particular bar code 90 that was distributed together with that tag 50. In this manner the association between the RFID tag 50 and the bar code 90 is unique. The act of the guardian entity 35 taking possession of the slip with the bar code is the unique association of the guardian entity 35 with the RFID tag 50 situated with the dependent 30. In FIG. 1 the RFID tags and bar codes as yet to be distributed are indicated as 50' and 90', denoting their as yet inactive status.

In a representative embodiment the guardian affixes the tag 50 onto the child, possibly in hidden manner, and keeps the bar code 90 situated with him/herself. As they meander about the locality 20, the processor 70 tracks the dependent 30 through the communications of the RFID tag 50 and the plurality of reader devices 60. If at some point in time the guardian entity 35 notes that the dependent 30 is not nearby anymore, the guardian entity goes to a scanning device which reads the bar code 90. The processor takes the reading of the bar code 90 as a validated command regarding RFID tag 50, and answers by informing the guardian entity on the whereabouts of the RFID tag 50. With such information the guardian entity can home-in on the dependent before possible harm could occur.

The details of these transactions, even for embodiments in which the authenticating system involves a code, can have practically an infinite number of variations. The scanning devices, might be the same ones used to scan merchandise labels, or they may be special ones installed for the locating system. The reader devices 60 may have scanners attached to them, and so on. The answer of the processor might also take many forms. It can go simply from giving a number indicating the ID number of the reader device, assuming reader devices are numbered for easy identification, that one which has the tag 50 in its range of coverage, to all the way of displaying, or quickly printing, a map with "you are here" and "there is the RFID tag you are looking for" arrows. Or, the processor might answer by relating to local fixtures, for instance: the dependent is in the toy department, etc. An answer of the processor can arrive through many means, such as display, voice, text, and others, all known in the art.

Depending on the sophistication of the tracking system, since as mentioned already schemes exist to extract more detailed location information regarding a tag than just in which reading device's range of coverage it is, the processor's response could also be very precise, for instance something like: "the tag is about 75 feet from you, in the direction of the staircase." Of course, if the guardian entity on its way toward the dependent would need additional guidance, upon reentering the code she/he would receive updated information.

There are many ways to use a code without using a slip with a bar code. The dispenser 80 might display a code possibly in the form of a password, which the guardian entity might write down, or might memorize. Instead of giving out a code, the dispenser 80 might ask for the guardian entity to set a code, such as a password. Keyboards, number pads, voice recognition, and other standard means of data entry are all possible variations for entering the code. The system may conceivably be used by the guardian entity even if the dependent does not go missing. Suppose the guardian entity would allow the dependent to stay in some area, while the guardian entity goes somewhere else. For instance, the dependent would remain at a book store in a mall, while the guardian entity goes shopping for clothing. The guardian entity could periodically enter the code to make sure that the dependent is still at the agreed upon location.

Although it is possible that owners or operators of such localities would offer the services of a locating system to their public for free, in a representative embodiment the customer, typically the guardian entity, would pay for using the locating system. However, since most elements of the system might be in place already for commercial reasons, the fees charged for the service would hopefully be very reasonable. Accordingly, the dispenser could also include some means for collecting fees. Such means can be, for instance, a coin slot, or a card swipe device. If a card is swiped, that by itself can serve as a code for the authenticating system. A later swipe at a proper location, for instance at a reader device, could count as a validated command for the processor.

For more sophisticated tracking of the dependent, such as extracting location information more accurate than the range of coverage of each RFID reader device, a more advanced RFID tag may also be needed. A further desired feature could be the recognition if a RFID separated from a dependent. It is possible that different guardian entities might desire, or willing to purchase, differing levels of tracking capabilities. One can accomplish such differentiation by offering at least one, and depending on the circumstances more, supplementary RFID tag to be situated with the dependent, which tag has such added capabilities. It may also be possible to build in all the desired elements into a single tag, offered for everybody.

In a representative embodiment the processor can observe a timed interval. This would mean that outside the timed interval the system would not function. This termination, or course, can take a variety forms, form stopping communications with the RFID tag 50, to not acknowledging commands. Time limits are useful for several reasons. One such reason might be not to over-clutter the system. The processor certainly can be aware if a certain tag left the place frequented by the public 20, but the tag might turn up again, so information such as associations would have to be saved indefinitely. Also, people might discard a RFID tag, which then would be communicated with for no good purpose indefinitely, although schemes can be devised for termination due to inactivity. Another reason for timed intervals is that the public would be able to purchase the services of the system for only the needed time. In a representative embodiment, means for setting a timed interval 75 can be a part of the dispensing apparatus 80. For instance, a guardian entity could buy the services of the system in hourly increments. Or, one could just dial in the time wanted and be charged accordingly. One can envision an almost "parking meter type" dispensing of the locating service. If the timed interval expires, for instance, the guardian entity could restart it with a payment and proper authentication, which reestablishes the associations. Frequent visitors, might buy daily, monthly, or indefinite passes, possibly for discounts. In an exemplary embodiment the commencing of the timed interval would be when the RFID tag is being dispensed. In alternate embodiment, one can have a dispenser which is not at the locality, such as receiving tags, codes, warning devices in the mail, or distributed at some central outlets. In such cases the associations may be stored in the processor at the time of dispensing the items. A timed interval could start in such cases when the system first detects the RFID tag 50.

Considering that one of the worries for a guardian entity could be that the dependent 30 leaves the premises, in an exemplary embodiment one can employ alarm devices. For instance, at an exit/entrance the system can have a specially placed reader device 60*a*. If such a specially placed reader device 60*a* detects a RFID tag 50 it might activate a public alarm 96. A guardian entity wishing to exit with the dependent, who has a tag still affixed and it is within a timed interval, might have to use the code to prevent activating of the public alarm 96. For instance, when the guardian entity enters the code, the system first might give a choice, do you want to turn the system off, or do you want location information? If the guardian entity chooses the "off" option, the alarm would not sound when the specially placed reader device 60*a* would detect that particular RFID tag. The alarm would not be activated for tags outside the timed interval, either.

In a further representative embodiment the system can employ, together or independently of the public alarm 96, a warning device 95 situated with the guardian entity. Such a device, for instance, a simple buzzer, can be distributed and associated at the dispenser 80. When a specially placed reader device 60*a* would pick up the RFID tag 50 the system would activate the warning device 95. Besides exits, there can be several other specially placed reader devices 60*a* in various locations deemed as potential hazards. The system could inform the guardian entity through the warning device 95 which specially placed reader device 60*a* has the child 30 in its range of coverage. The information can be distinctive rings, or text, or language messages. The guardian entity then can then decide how to react. In a typical case the dependent 30 is not lost and the guarding would ignore the warning device 95 activation. But for exceptional cases, such as for instance when the dependent is lost and the guardian entity has not yet noticed this, or has not yet entered the code, such warning signals can potentially be life savers.

In a further exemplary embodiment one can omit the code associated with the guardian entity, and only use a warning device 95 situated with the guardian entity, as this too is uniquely associated with the tag 50 and the guardian 35. In this embodiment the guardian entity could not issue a valid command to obtain the location information regarding the dependent, but the guardian entity would be warned if the dependent is in the range of coverage of a specially placed reading device 60*a,* indicating danger.

The warning device 95' may be inexpensive enough to be purchased, or given away, together with the RFID tag 50', for instance at the dispensing apparatus 80. Again, the still unissued device is indicated with an "", as 95'. Alternatively, a renting type of arrangement can be instituted, where most of a deposit would be returned upon returning the warning device 95. The deposit required for the warning device 95 would be large enough to compensate for the case of non returning. It is anticipated that the vast majority of users would promptly return the warning device associated with the guardian entity. Such transactions as the picking up of the warning device, associating the warning device with the RFID tag 50, and with the code 90, paying a deposit, receiving refund upon return, can all be easily automated at the dispensing site 80, expecting operator intervention only cases of a malfunction.

In a representative embodiment the guardian entity 35 can also enter the code through a first radio device 97 using a radio transmission. In this manner the guardian entity 35 would not have to reach a physical location where the code can be entered for the processor. Also, if the code is stored in the first radio device 97 the guardian entity 35 would not have to memorize anything, would only have to, for instance, push a button on the first radio device 97 to send out the code. The associations for such a radio transmission to be accepted as a validated command can proceed the in the same manner as for other type of codes, or the warning device 95, as was already discussed. As an example, a suitable way to provide the guardian with the first radio device 97 would be while the tag 50 is dispensed. At this point the tag 50 and first radio device 97 would register with the processor, thereby being uniquely associated, and with the first radio device 97 being in the possession of the guardian entity 35, all associations are in place for a functioning authenticating system. The locating system would have receiving devices, such as known in the art, to receive the communications sent out by the first radio device 97.

It may be preferable to combine into one single unit the warning device 95 and the first radio device 97, by using a more sophisticated device which has two-way communication capabilities. With such a combination device the information regarding the dependent would be received immediately back into the same device from which the code was transmitted. The combination device in this version of the embodiment would preferably possess voice and/or display means, such as are known in the art. Such two-way communication capability devices are well known, for instance "walkie-talkie" (small portable radio link (receiver and transmitter)) type devices, or variations on a cellular telephone possibly with graphics capabilities. The particular communication means of the first radio device, or of a combination device, are such that it can be easily deal with within the technology of known arts.

In embodiments involving warning devices, it is possible, especially for the more sophisticated ones such as the just discussed combination device, that communications would be encrypted, to exclude unauthorized entities from receiving sensitive information.

Figure 2:
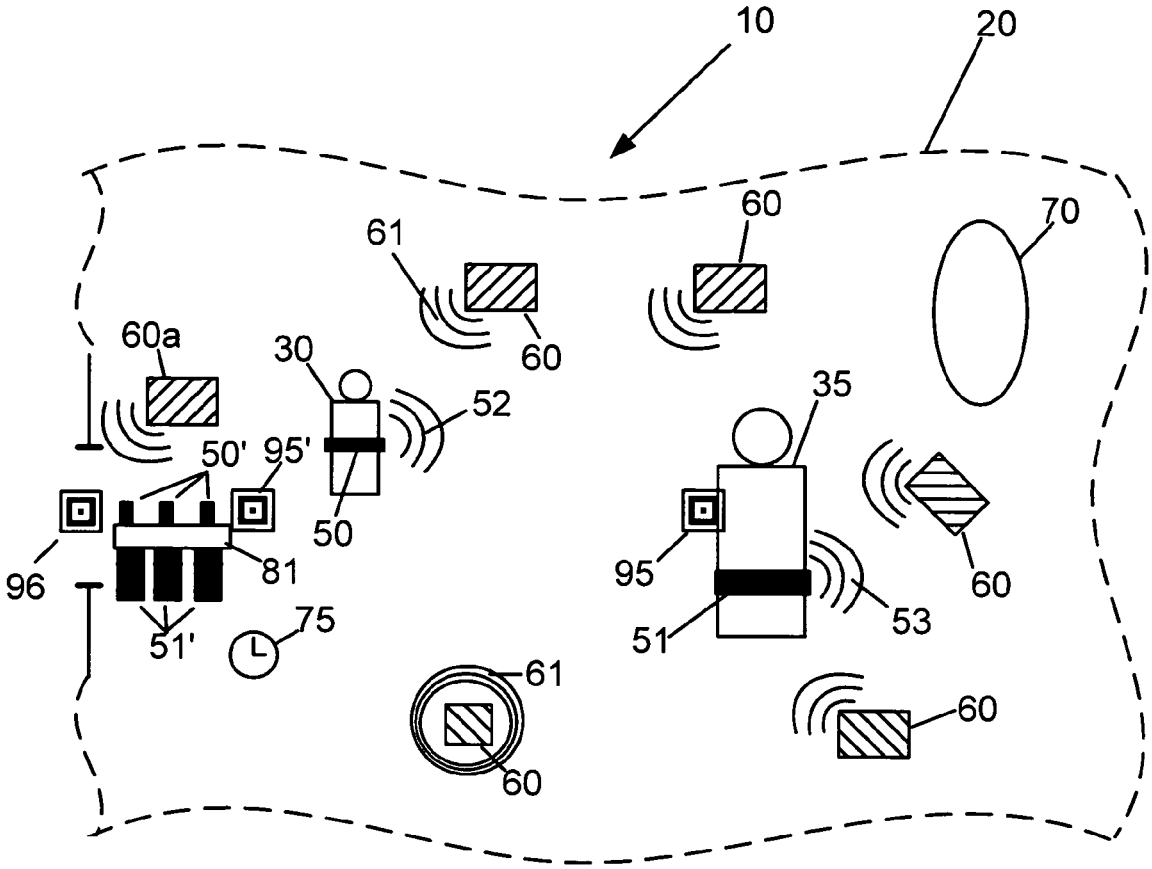
FIG. 2 shows a schematic view of an another exemplary embodiment for a system and method to locate a dependent.

FIG. 2 shows a schematic view of another exemplary embodiment for a system and method 10 for locating a dependent. The difference between the embodiments which are schematically shown on FIG. 1 and FIG. 2, is in the authenticating system. In the embodiment of FIG. 2, the authenticating system includes an additional RFID tag 51 situated with the guardian entity 35. The processor 70 directs communications between the plurality of reader devices 60 and the additional RFID tag 51, and the processor 70 also tracks the additional RFID tag 51. The additional tag 51 can be very similar, even of identical type, to the RFID tag 50 of the dependent 30. The additional RFID tag 51 has, or course, its own antenna and electromagnetic wave 53 reception and transmission. The authenticating system is established when the processor receives the information that the RFID tag 50 of the dependent 30 and the additional RFID tag 51 of the guardian entity 35 are associated, and the tags are situated with the dependent and the guardian, respectively. Since the processor tracks both tags, it can correlate the tracking of the RFID tag 50 and the tracking of the additional RFID tag 51. The potential threat of the dependent 30 being lost, meaning that the dependent is endangered, would be extracted by the processor from such a correlation. Observation of a certain patterns in the correlation, which patterns would indicate that intervention by the system on the behalf of the guardian entity is needed, would be taken by the processor as a validated command. Accordingly, if in the correlating of the tracking of the two RFID tags 50 and 51, a pattern of endangerment for the dependent is recognized, the system is ready to act. There are many ways patterns of endangerment can be recognized in such a correlation. For instance, an easily recognizable simple such pattern, with the tracking information available for the processor only having the extent of which RFID reader device has which RFID tag in its range, would be one when any one of the reader devices 60 has the RFID tag 50 in its range of coverage and at the same time does not have the additional RFID tag 51 in its range of coverage. Knowing the particular details of the layout of a locality 20, the amount of coverage the plurality of reader devices 60 have, the amount of information communicated by the tags 50 and 51, and other details of the environment, one can always find out which patterns in the mutual movement of the two tags are indications that the dependent might be endangered, typically by being outside of a safety zone surrounding the guardian entity. Such patterns in the correlation of the tracking of the two tags can be stored in the memory of the processor. At least one pattern of endangerment, for instance the discussed simple one, is preferably always stored in memory. During actual tracking of the tags, the processor in real time compares the observed patterns with the stored patterns, to see whether any of the observed patterns show endangerment for the dependent.

The invention contemplates that apart of the patterns recognized ahead of time and stored in the memory, a processor using for instance neural networks, which are already in the art of computational science, and additional learning techniques, could on its own learn a patterns of endangerment from experience. These learned patterns might turn out to be more insightful than any of the ones stored ahead of time in the memory of the processor by operators of the system.

In a representative embodiment the response of the processor to a command which emerges from the tracking correlation of the two RFID tags, the RFID tag 50 and the additional RFID tag 51, can be the activation of a warning device 95. At the dispenser 81, which in this case dispenses two associated RFID tags 50' and 51', the guardian entity would also be issued a warning device 95' associated at least with the tag 51 of the guardian entity 35. Again, on the figure the as yet un-dispensed components are marked with adding "'" after their indicating numbers, such as 50', 51', and 95'.

Depending on the RFID technology in use, the information derived from the tracking of the two tags can be quite sophisticated. The processor might be able to know the distance between the two tags to within a few feet. Also knowing the particular details of the locality 20, the processor might be able to react by activating the warning device 95, when the distance between the tags increases to an unacceptable level. For simpler RFID locating system, where the processor is only aware which reader device has which tag in its range of coverage, one also can use effective correlation schemes. In a representative embodiment such a simple correlation scheme can be whether the RFID tag 50 and the additional RFID tag 51 are in the range of coverage of the same reader device 60, as already presented earlier in discussing patterns in the correlation of tag movement. If any one of the reader devices 60 has the RFID tag 50 in its range of coverage, and at the same time does not have the additional RFID tag 51 in its range of coverage, the processor would consider that a validated command, and would respond by activating the warning device 95. One can implement refinements in this basic scheme, for instance, waiting for a short time for the two tags to reemerge in the same range of coverage. Also, for instance, the processor can deduct useful information from the speed with which the tags 50 and 51 are moving between the ranges, to know how immediately the warning device must be activated. Also, if the coverage ranges of some of the RFID devices overlap, more useful patterns in the correlation of the two tags can probably be extracted.

The term activating the warning can mean differing levels of sophistication. Depending on the warning device 95, the activation may be a simple beep or shake, or it could be the best possible positioning information by voice, or picture.

In this embodiment, schematically shown on FIG. 2, the guardian entity 35 does not have to notice the missing of the dependent 30 before the processor receives a validated command. The guardian entity needs to do nothing more than to make sure to be staying situated with the additional RFID tag 51, and the processor 70 by tracking both tags 50 and 51 can deduce from the pattern of their correlation if potential danger arises.

The system of this embodiment achieves of keeping a first mobile RFID tag 50, namely one situated with the dependent 30, within a zone of a second mobile RFID 51, namely one situated with the guardian entity 35, while both tags move about the locality 20. The extent of this zone at any given locality can be predetermined under such well defined criteria, for instance, that the dependent 30 when located within this zone should be safe as the result of the nearby presence of the guardian entity 35. If the relation between the dependent 30 and guardian entity 35 is different than protective one, that too is known, and such information can be folded into the determination of the zone. As the guardian moves about, the zone moves too, and it can change in extent, and in shape, depending on the environment of the locality. But, for any given locality, and any given RFID technology in use, such a safe zone around a second mobile RFID tag 51 can be deduced ahead of time the actual use of the system. The pattern of this zone is then stored in the memory of the processor 70 for use in the exercising of the system. The need of keeping a first mobile tag 50 in a zone of a second mobile tag 51 may also arise in completely differing scenarios from that of a dependent 30 and a guardian entity 35. The disclosed system could be used equally as well for any such case, one just would determine the zone based on criteria pertaining to that particular considered application, and the pattern of that zone would be stored in the memory of the processor. Finding a zone around the second mobile RFID tag 51, and recognizing when this zone might be moved out of by the first mobile RFID tag 50, is not different than recognizing the already discussed patterns of endangerments in the tracking correlations of two mobile tags. Again, it is contemplated that the processor will learn more and more patterns of interest, but at least one such pattern of the first mobile tag 50 moving out of the zone of the second mobile RFID tag 51 is stored ahead of time in the memory of the processor. This at least one pattern can, for instance, again be the previously presented simple one, when moving out of the zone is indicated by the pattern of any one of the plurality of RFID reader devices 60 having the first mobile RFID tag 50 in its range of coverage and not having the second mobile RFID tag 51 in its range of coverage. If leaving the zone is observed, the processor sends an alert to the guardian entity, typically by activating the warning device 95. Such a system of keeping a first mobile RFID tag within a zone of a second mobile RFID while both tags move about a locality may have general applications outside the area of concerning dependents and guardians.

In relation to a specially placed reader device, such as 60*a*, the warning device 95 can function in a similar fashion as with all the other reader devices 60. If the RFID tag 50 is in the range of coverage of a specially placed reader device 60*a*, and at the same time the RFID tag 51 situated with the guardian entity 35 is not, the system activates the warning device associated with the guardian entity 95. If both tags 50 and 51 are in the range of a specially placed reader device 60*a* then is no action taken. Similarly with a public alarm 96, it would only activate if the RFID tag 50 is in the range of coverage of the specially placed reader device 60*a* at the public alarm site, and the RFID tag 51 situated with the guardian entity 35 is not in the range. Again, for each case the processor might wait a short time for both tags to enter the range of a specially placed reader device 60*a*, before activating the alarm. A public alarm 96 can be a sound alarm, or a silent one alerting authorities. All manners of alarms are know in the arts.

The system schematically shown on FIG. 2 would handle the timed intervals 75, the payments of customers, the renting or buying of the alarms, warning devices, supplementary RFID tags, essentially in the same manner as described for the embodiment of the system schematically shown on FIG. 1.

Figure 3:
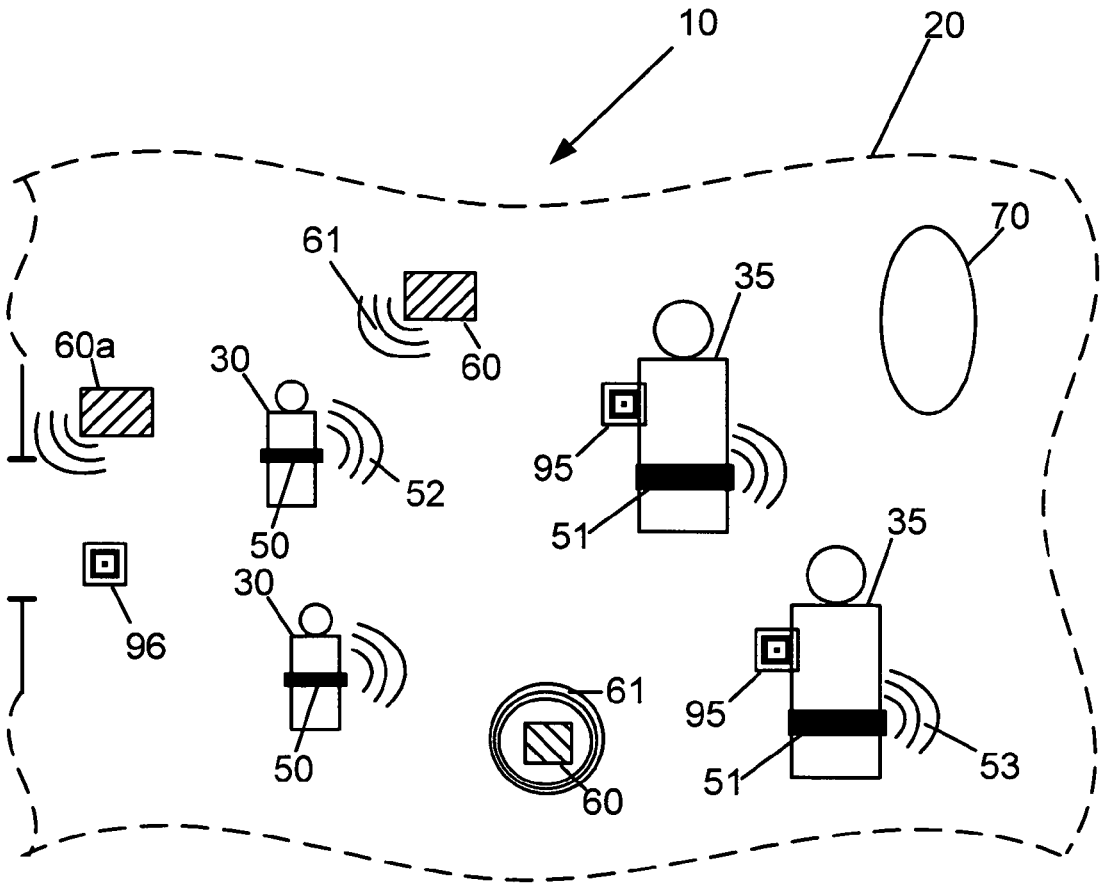
FIG. 3 shows a schematic view of a small plurality of dependents and a small plurality guardian entities in a system and method for locating a dependent.

FIG. 3 shows a schematic view of a small plurality, of dependents and a small plurality guardian entities in a system for locating a dependent, where the authenticating system comprise an additional RFID tag 51. For this invention a small plurality means between 2 and about 20 for dependents 30, and between 2 and about 10 for guardian entities 35. Every aspect of the invention as described for exemplary embodiment of one dependent and one guardian entity, can straightforwardly be extended to small pluralities of each. For instance, if there is a small plurality of dependents 30 and one guardian entity 35, in the simple correlation embodiment the warning device is activated when any of the tags 50 situated with dependents 30 are in the range of a reader device by themselves without a guardian entity's tag 51 being present. Similarly, if there is one dependent 30 and more guardian entities 35 having RFID tags 51, the warning device of all guardian entities can be activated, or only for that guardian entity who is the nearest to that range of coverage of a reader device 60 that has the RFID tag 30 in its rage without any of the tags 51 of any of the guardian entities. With a small plurality of dependents 30 and small plurality of guardian entities, similarly, a RFID tag 50 alone in a range of coverage of any reader device 60, would activate one or more of the warning devices 95 associated with the guardian entities 35.

For embodiments with small pluralities too, more sophisticated tracking correlations are not difficult to contemplate. Such might be taking timing information of the trackings into consideration. Situations where the system would be exercised with small pluralities of participants could arise, for instance, during a school visit of a given place frequented by the public. Students and teachers, representing dependents and guardian entities, can constitute groups of small pluralities.

If need for larger number were to arise often, the capabilities of a system for locating a dependent could be extended to handle large number of participants, in the hundreds if needed, along the lines of teaching as described for small pluralities.

Many modifications and variations of the present invention are possible in light of the above teachings, and could be apparent for those skilled in the art. The scope of the invention is defined by the appended claims.

We claim:

1. A method for locating a dependent by a guardian entity at a locality, said method comprising:

situating a RFID tag with said dependent;

distributing about said locality a plurality of RFID reader devices capable of communicating with said RFID tag;

in a processor having a memory, directing communications between said RFID tag and said plurality of RFID reader devices, and tracking said RFID tag as said dependent is moving about said locality;

in an authenticating system, uniquely associating said RFID tag with said guardian entity, wherein a command pertaining to said tracking of said RFID tag is accepted by said processor only if said command is validated by said authenticating system; and in said processor, upon receipt of a validated command, generating a response, wherein said response comprises providing said guardian entity with a location information regarding said dependent.

2. The method of claim 1, further comprising dispensing said RFID tag to said dependent.

3. The method of claim 2, further comprising halting said method upon the expiration of a timed interval.

4. The method of claim 3, further comprising commencing said timed interval when said RFID tag is being dispensed.

5. The method of claim 1, wherein said situating said RFID tag is carried out by affixing said RFID tag thereon said dependent in a hidden manner.

6. The method of claim 1, wherein each one of said plurality of RFID reader devices has a range of coverage, further comprising activating a warning device situated with said guardian entity when said RFID tag is being in said range of coverage of a specially placed RFID reader device.

7. The method of claim 1, wherein said associating comprise providing a code for said guardian entity, wherein said code is uniquely associated with said RFID tag, and wherein entering said code thereinto said processor is said validated command.

8. The method of claim 7, further comprising dispensing said RFID tag to said dependent, and carrying out said providing of said code essentially concurrently with said dispensing.

9. The method of claim 7, wherein said guardian entity is entering said code by using a radio transmission.

10. The method of claim 1, wherein said associating comprise situating with said guardian entity an additional RFID tag uniquely associated with said RFID tag, further comprising in said processor, directing communications between said additional RFID tag and said plurality of RFID reader devices, and tracking said additional RFID tag as said guardian entity is moving about said locality.

11. The method of claim 10, further comprising in said processor, correlating said tracking of said RFID tag and said tracking of said additional RFID tag, and accepting as said validated command if in said correlating a pattern of endangerment for said dependent is recognized, wherein said pattern of endangerment has been stored in said memory of said processor.

12. The method of claim 11, wherein said pattern of endangerment was learnt by said processor.

13. The method of claim 11, further comprising situating a warning device with said guardian entity, wherein said response comprise activating said warning device.

14. The method of claim 11, further comprising situating a warning device with said guardian entity, wherein each one of said plurality of RFID reader devices has a range of coverage, wherein said pattern of endangerment comprises any one of said plurality of RFID reader devices having said RFID tag in its said range of coverage and not having said additional RFID tag in its said range of coverage, wherein said response comprise activating said warning device.

15. The method of claim 1, wherein each one of said plurality of RFID reader devices has a range of coverage, further comprising activating a public alarm device when said RFID tag is being in said range of coverage of a specially placed RFID reader device.

16. The method of claim 1, further comprising situating from 2 to about 20 of said RFID tags with same from 2 to about 20 of said dependents.

17. The method of claim 1, further comprising from 2 to about 10 of said guardian entities.

18. The method of claim 1, further comprising situating at least one supplementary RFID tag with said dependent.

19. A method for finding a child by a guardian entity at a place frequented by the public, said method comprising:

dispensing a RFID tag to said child;

situating said RFID tag with said child;

distributing about said place frequented by the public a plurality of RFID reader devices capable of communicating with said RFID tag; and in a processor, directing communications between said RFID tag and said plurality of RFID reader devices, and tracking said RFID tag as said child is moving about said place frequented by the public;

dispensing a code to said guardian entity, wherein said code is uniquely associated with said RFID tag and suitable to be entered thereinto said processor; and in said processor, in case of receiving said code, generating a response, wherein said response comprises providing said guardian entity with a location information regarding said child.

20. The method of claim 19, wherein said guardian entity is entering said code by using a radio transmission.

21. The method of claim 19, further comprising halting said method upon the expiration of a timed interval.

* * * * *